United States Patent [19]

Doi et al.

[11] Patent Number: 4,710,345

[45] Date of Patent: Dec. 1, 1987

[54] MANUFACTURING METHOD OF SUPER-HEAT-RESISTING ALLOY MATERIAL

[75] Inventors: Yoshihiko Doi; Nobuhito Kuroishi; Shigeki Ochi; Noboru Uenishi, all of Itami, Japan

[73] Assignee: Japan as represented by Director-General, Agency of Industrial Science & Technology, Tokyo, Japan

[21] Appl. No.: 852,966

[22] PCT Filed: Oct. 26, 1985

[86] PCT No.: PCT/JP85/00595

§ 371 Date: Apr. 22, 1986

§ 102(e) Date: Apr. 22, 1986

[87] PCT Pub. No.: WO86/02669

PCT Pub. Date: May 9, 1986

[30] Foreign Application Priority Data

Oct. 26, 1984 [JP] Japan ..... 59-224094
Oct. 26, 1984 [JP] Japan ..... 59-224095

[51] Int. Cl.[4] ..... B22F 3/24

[52] U.S. Cl. ..... 419/28; 419/29; 419/30; 419/49; 419/57; 419/60; 419/68

[58] Field of Search ..... 419/68, 28, 30, 60, 419/29, 49, 57

[56] References Cited

U.S. PATENT DOCUMENTS

| | | | |
|---|---|---|---|
| 2,783,504 | 3/1957 | Hamjian et al. | 419/68 |
| 3,793,014 | 2/1974 | Rosenwasser | 419/68 |
| 4,526,747 | 7/1985 | Schimmel et al. | 419/68 |

FOREIGN PATENT DOCUMENTS

| | | |
|---|---|---|
| 0065702 | 1/1982 | European Pat. Off. . |
| 2522636 | 11/1976 | Fed. Rep. of Germany . |
| 53-710 | 4/1977 | Japan . |
| 151608 | 12/1977 | Japan . |
| 1300864 | 12/1972 | United Kingdom . |
| 2084612 | 4/1982 | United Kingdom . |

*Primary Examiner*—Stephen J. Lechert, Jr.
*Attorney, Agent, or Firm*—Cushman, Darby & Cushman

[57] ABSTRACT

A manufacturing method of super-heat-resisting alloy material characterized in comprising the steps of: (1) filling and sealing the powder of Ni-based super-heat-resisting alloy in a rubber mold; (2) subjecting the powder in the rubber mold to cold isostatic pressing; (3) sintering the compact in vacuum or in gas atmosphere at a temperature of 1000° C. or more so that the sintered density increases to 95% or more than the theoretical density; and (4) next, subjecting the sintered compact to hot isostatic pressing.

4 Claims, 1 Drawing Figure

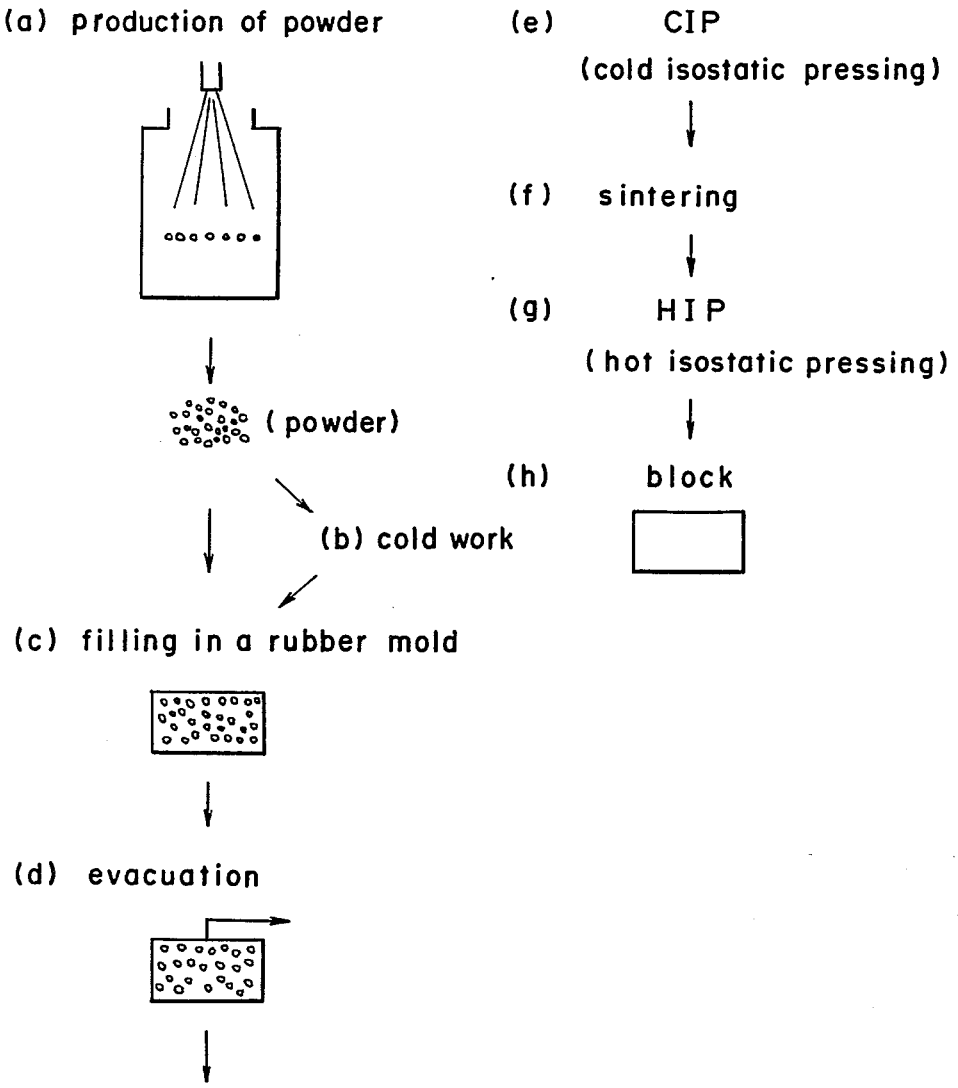
(a) production of powder
(powder)
(b) cold work
(c) filling in a rubber mold
(d) evacuation
(e) CIP
(cold isostatic pressing)
(f) sintering
(g) HIP
(hot isostatic pressing)
(h) block

MANUFACTURING METHOD OF SUPER-HEAT-RESISTING ALLOY MATERIAL

TECHNICAL FIELD

The present invention relates to a manufacturing method of super-heat-resisting alloy material, especially of super-heat-resisting alloy material appropriate for superplastic forming of turbine disc, turbine blade, an integrated body of turbine disc and blades, and others, by using powder metallurgy.

BACKGROUND ART

The improvement in the durable temperature of super-heat-resisting alloy which should be used at a high temperature has been recognized as a pressing need for energy-saving. The increase in the amounts of elements to be added in order to satisfy this requirement has a disadvantage that it lowers the workability of super-heat-resisting alloy material.

The superplastic forming method is a process which is capable of solving this problem. It is a process for obtaining a work having a complex configuration with an extremely large amount of deformation by processing the material under conditions that it can show the superplasticity.

Superplastic forming has following characteristics: (1) A material can be deformed at a low stress level. Therefore, vacuum forming and gas pressure forming can be used. (2) The deformability is so large as to allow the material to take a complex configuration. Then, the machining cost can be saved. (3) Since the work does not have such a residual stress as generated upon cold working, the corrosion resistance is improved and the precision level of the size is maintained to be stable. (4) The surface of a work is in a good state even after working. Therefore, the superplastic forming method has an advantage that it is appropriate for the forming of such an alloy as is difficult to work with ordinary forming processes.

Superplastic deformation which has these characteristics is broken down into two types; one of which makes use of micrograin superplasticity and the other makes use of transformation superplasticity. The superplastic deformation process to be used in this invention is the process which makes use of the former type of superplasticity, according to which it becomes necessary to produce a material for superplastic forging having grain size level below several micrometers.

The powder metallurgy, utilizing the atomization process or others which have been developed recently, makes it possible to produce such a material for superplastic forming mentioned above. The present invention relates to a production of a super-heat-resisting alloy material, specially to a material appropriate to the superplastic deformation which makes use of powder metallurgy.

Priorly, a material for superplastic deformation has been produced by either powder extrusion, according to which the alloy powder is extruded at a temperature just below the recrystalization temperature and is allowed to recrystalize by the heat generated upon the extrusion so as to have a micrograin structure of grain size of 10 $\mu$m or less, or hot isostatic pressing (HIP) according to which the alloy powder is filled in a capsule and then is consolidated under the conditions of high pressure and high temperature.

However, the powder extrusion process has a disadvantage that the production of a large material requires a large-scale and very costly extrusion machine. On the other hand, according to the HIP process, there are invited such disadvantages that the absorbed gas contamination on the surface of the powder is confined in the material due to the air-tight seal of the capsule so that the trapped gas affects the characteristics of deformation on superplastic forging and deteriorates the deformability, and an that the air-tight sealing upon filling the powder into the capsule is difficult. No leaks should be allowed, and so we should pay attention to every seal position of the capsule, especially to welded positions. Even slight leak allows the high pressure gas to enter into the capsule. Then, the gas is confined in invisible voids when the powder is consolidated into a completely densified state and spreads in the material during the heat treatment at a high temperature to affect the mechanical properties of a product undesirably.

DISCLOSURE OF THE INVENTION

A purpose of the present invention is to provide a manufacturing method of super-heat-resisting alloy by using the powder metallurgy, wherein hot isostatic pressing with no use of capsule is used.

Another purpose of the present invention is to provide a manufacturing method of super-heat-resisting alloy material especially suitable for the production of superplastic forming material.

The present invention discloses a new manufacturing method of a material with micrograin crystallographic texture different from the abovementioned two prior methods, and it overcomes the disadvantages of the prior methods.

In the manufacturing method of super-heat-resisting alloy material according to the present invention, as illustrated in the Figure attached, after powder of Ni-based super-heat-resisting alloy was filled and sealed in a rubber mold which had been prepared to have an appropriate configuration within an inner space (Steps (c) and (d) in the FIG.), the powder in the rubber mold is subjected to the compacting under hydrostatic pressure (Step (e) in the FIG.). The resultant compact is sintered at a temperature of 1000° C. or more (Step (f) in the FIG.) to densify it and is recrystalized so as to form a microstructure which has very fined grains. In addition to the above-mentioned processes, the compact is subjected to the hot isostatic pressing (HIP) in order to densify it further (Step (g) in the FIG. ).

The term "Ni-based super-heat-resisting alloy" includes an alloy which consists of chrominum up to 60 wt %, cobalt up to 30 wt %, aluminum up to 10 wt %, titanium up to 8 wt %, molydenum up to 30 wt %, tungsten up to 25 wt %, niobium up to 10 wt %, tantalum up to 10 wt %, zirconium up to 7 wt %, boron up to 0.5 wt %, hafnium up to 5 wt %, vanadium up to 2 wt %, copper up to 6 wt %, manganese up to 5 wt %, iron up to 70 wt %, silicon up to 4 wt %, carbon up to 4 wt %, dispersoid up to 10 wt %, and the remainder of nickel.

The powder of Ni-based super-heat-resisting alloy can be produced by means of a powder manufacturing process such as a centrifugal atomization process (for example, rotating electrode process, plasma rotating electrode process, electron-beam rotary disc process), argon gas atomization process, vacuum atomization process, and (twin) roller atomization process (Step (a) in the FIG. ).

A dispersoid may be an oxide such as alumina, yttria, a boride and a fluoride.

The compacting pressure of the cold isostatic pressing (CIP) is preferably as high as 4000 kgf/cm$^2$ or more. A pressure lower than 4000 kgf/cm$^2$ makes it impossible to compact a super-heat-resisting alloy powder to a degree needed in the present invention. By applying a compacting pressure of 4000 kgf/cm$^2$ or more, working strain can be induced effectively in the powder and this makes it possible to accelerate the refinement of grain size on recrystalization in the sintering process so as to obtain a densified material for superplastic deformation with fine grained-size structure.

The compact by the cold isostatic pressing is sintered in vacuum or in inert gas atomosphere at a temperature of 1000° C. or more to densify the compact in order to obtain a material of 95% or more of theoretical density ratio .

The density of the sintered body thus produced must be 95% or more of theoretical density ratio; Otherwise, vacancies in the sintered body join together to form continueous pores which cause following problems: A large amount of pores remain in the sintered body after the hot isostatic pressing, and the sintered body cannot be densified when no capsule is used in the hot isostatic pressing.

The sintering is preferably processed in vacuum or in an non-oxidizing environment such as inert and reducing atomosphere, and the sintering temperature must be 1000° C. or higher in order to produce a sintered body which has a density of 95% or more of the theoretical density ratio. The hot isostatic pressing is possible for a sintered body which has a density of 95% or more of the theoretical density even if the sintered body is not enveloped in a capsule. In other words, such a sintered body can be densified easily by the hot isostatic pressing.

Furthermore, the recrystalization during the consolidation can produce a material which has 5 μm or less of the average grain size.

It is appropriate for the manufacturing method of a better material for superplastic forming that the hot isostatic pressing is processed for thirty minutes or more, at a relatively higher temperature in a range from 1100 to 1200° C., at a relatively higher pressure in a range of 1000 kgf/cm$^2$ or more. This process increases the adhesive strength of powders and controls the distribution of the pores so that a material thus produced shows more remarkable superplastic behavior and is best for the superplastic forging.

On the other hand, at temperatures and pressures below the above-mentioned ranges, the adhesive strength of powders and the densification of a material thus produced by HIP are not enough for the appearence of superplastic behavior. At temperatures higher than the above-mentioned range, the crystal grains coarsen.

In other words, the present invention discloses the HIP conditions which prevent the coarsening of crystallographic grain size and enhance both adhesive strength of powders and densification thereof, and it also discloses a manufacturing method of a material which has high deformability on superplastic deformation followed after the HIP process. In general, the superplastic deformation is processed at a temperature in a range between about 950° C. and about 1100° C. under ambient or inert gas atmosphere.

In the material thus manufactured (Step (h) in the FIG.), the absorbed gas on the surface of powders has been removed by using the vacuum or inert gas atomosphere in the material in the sintering and the HIP processes so that the content of the oxygen which affect bad influence in a following superplastic forging process can be lowered to 50 ppm or less.

Thus, according to the present invention, a sintered body (a super-heat-resisting alloy material) of 50 ppm or less of the oxygen content and of 5 μm or less of the average crystal grain size can be manufactured.

An advantage of the method according to the present invention is that because a mold used in the cold isostatic pressing (CIP) is made of rubber, it can be used repeatedly and its cost is relatively low.

A further advantage of the method according to the present invention is that a super-heat-resisting alloy material of large size can be manufactured relatively easily when compared with the conventional extrusion process.

A still further advantage of the method according to the present invention is that the hot isostatic pressing (HIP) can be applied without enveloping the material in a capsule.

Another advantage of the method according to the present invention is that a material which has a complex configuration appropriate for following superplastic forging process can be manufactured easily by forming a mold similarly to that of the product so that the conditions of superplastic deformation can be simplified and the superplastic deformation can be done efficiently. In other words, by using a super-heat-resisting alloy material manufactured according to the present invention which has the average grain size of 5 μm or less, a low oxygen content and a density nearly equal to the theoretical density, a body having a required configuration can be manufactured with superplastic forging of $10^{-1}$ $sec^{-1}$ or less of low strain rate in the conditions of the appearance of superplasticity. The body thus manufactured can be finished to a final product of high strength and high hardness by using known heat treatment such as solution heat treatment, stabilization heat treatment and precipitation heat treatment.

By applying a proper cold-working to a spherical powders to deform it into a shape different from sphere before filling it into a rubber mold, the entanglement of powders on CIP is enhanced to improve its formability and, thereby, it becomes possible to make a compact at a compacting pressure lower than 4000 kgf/cm$^2$.

The cold work of super-heat-resisting alloy powder before filling the powder in a rubber mold (Step (b) in the FIG.) makes the shapes of the powder different from sphere. This enhances the entanglement of the powder on CIP so that the formability is improved and the forming becomes possible at a low compacting pressure. Further, the cold work gives the strain to the powder in advance, and this increases the number of the nucleation sites for recrystallization on the sintering. Then, the grain size of a material thus produced are refined so that a material which shows the more remarkable superplastic behavior can be manufactured.

The cold work of the powder can be processed by using a conventional apparatus such as an attritor, a ball mill and an oscillation mill.

Especially among them, an attritor is an apparatus, wherein the powders are charged into a container together with balls made from steel, nickel, tungsten carbide, stainless steel or the like, and they are agitated by a rorating impeller to give the powders impact forces. An attritor has an advantage that the effect of the cold work on the powder can be obtained in a short time. Further, by using a dry process wherein the atomosphere is inert gas, good powder which has been subjected little to the oxidization can be obtained.

A material made from the powder processed by a dry attritor deforms at a lower flow stress and has a larger maximum of the elongation when compared with that not processed by a dry attritor. Further, it can also have higher deformability in a high strain rate range and/or in a lower temperature range.

BRIEF EXPLANATION OF THE DRAWING

FIGURE is a diagram which shows manufacturing steps of a super-heat-resisting alloy material.

BEST MODE FOR CARRYING OUT THE INVENTION CLAIMED

(Example 1)

The powder of a Ni-based super-heat-resisting alloy which consists of 0.1 wt % C, 10.0 wt % Cr, 3.5 wt % Mo, 1.0 wt % Fe, 14.0 wt % Co, 4.5 wt % Al, 5.5 wt % Ti, 0.01 wt % B, 1.0 wt % V, 0.05 wt % Zr and the remainder of Ni and has the 145 μm or less of particle size is produced with the vacuum atomization process. The powder is filled in a rubber tube of 25 mm of the inner diameter and is evacuated. Then, the powder is subjected to the cold isostatic pressing at a compacting pressure of 6000 kgf/cm$^2$ to compact a body. The compact is sintered under vacuum of $10^{-3}$ torr at a temperature of 1150° C. Next, it is subjected to the hot isostatic pressing in conditions of 1160° C. and 1900 kgf/cm$^2$ for one hour. The average grain size of a material for superplastic deformation thus produced is about 10 μm, and its density is 96%.

A sample of 10 mm gauge length and 6 mm diameter is cut from the material thus manufactured, and it is subjected to the superplastic tensile test in the condition of strain rate of $10^{-3}$ sec$^{-1}$ or less at 1040° C. The elongation attains to about 300% so that the superplastic forging is confirmed to be possible.

(Example 2)

The powder of a Ni-based super-heat-resisting alloy which consists of 0.1 wt % C, 10.0 wt % Cr, 3.5 wt % Mo, 1.0 wt % Fe, 14.0 wt % Co, 4.5 wt % Al, 5.5 wt % Ti, 0.01 wt % B, 1.0 wt % V, 0.05 wt % Zr and the remainder of Ni and has 145 μm or less of the particle size is produced with the plasma rotating electrode process. The powder is subjected to the cold work with a dry attritor in the rotation condition of the agitator of 200 rpm for 25 minutes. The powder thus processed is subjected to CIP, the sintering and HIP in the conditions similar to those in Example 1. The average grain size of the material for superplastic forging produced is about 5 μm and its density is 95%.

A sample of 10 mm gauge length and 6 mm diameter is cut from the material thus manufactured, and it is subjected to a superplastic tensile test in the condition of $10^{-3}$ sec$^{-1}$ or less of strain rate at 1040° C. The elongation attains to about 340 so that the superplastic forging is confirmed to be possible.

(Example 3)

The powder of a Ni-based super-heat-resisting alloy which consists of 0.05 wt % C, 15.0 wt % Cr, 5.0 wt % Mo, 18.0 wt % Co, 4 wt % Al, 3.5 wt % Ti, 0.03 wt % B and the remainder of Ni and has 149 μm or less of the particle size is produced with the argon gas atomization process. The powder is subjected to the cold work with a dry attritor in the rotation condition of the agitator of 250 rpm for one hour. The powder thus processed is filled in a rubber tube and is evacuated. Then, the powder is subjected to the cold isostatic pressing at a compacting pressure of 5500 kgf/cm$^2$ to compact a body. The compact is sintered under vacuum of $10^{-5}$ torr at a temperature of 1170° C. for three hours. Next, the sintered body is subjected to HIP process for one hour in each condition of (1) 1110° C.×1300 kgf/cm$^2$, (2) 1130° C.×1500 kgf/cm$^2$, (3) 1160° C.×1900 kgf/cm$^2$, (4) 1180° C.×1000 kgf/cm$^2$ and (5) 900° C.×1300 kgf/cm$^2$, and the powder is consolidated.

A sample of 10 mm gauge length and 6 mm diameter is cut from the material thus manufactured, and it is subjected to superplastic tensile test in the condition of $8.33\times10^{-4}$ sec$^{-1}$ of strain rate at 1040° C. The elongation of the sample of the material subjected to the HIP process in the condition (5) wherein the temperature is lower than 1100° C. attains less than 100%, whereas that of the samples of the materials subjected to the HIP processing is in the conditions (1) to (4) wherein a temperature in a range between 1100° C. and 1200° C. and a pressure is 1000 kgf/cm$^2$ or more attain more than 300%, 500%, 500% and 200%, respectively, so that the superplastic forging is confirmed to be possible.

(Example 4)

The powder of a Ni-based super-heat-resisting alloy which consists of 0.1 wt % C., 14.0 wt % Cr, 3.5 wt % Mo, 8.0 wt % Co, 3.5 wt % Al, 2.5 wt % Ti, 0.01 wt % B, 3.5 wt % Nb, 3.6 wt % W, 0.05 wt % Zr and the remainder of Ni and has the particle size of 100 μm or less is produced with the vacuum atomization process. The powder is filled in a rubber tube and is evacuated. Then, the powder is subjected to the cold isostatic pressing at 5000 kgf/cm$^2$. The compact is sintered under argon gas atomosphere at 1160° C. for two hours. Next, it is subjected to the hot isostatic pressing in conditions of 1180° C. and 1900 kgf/cm$^2$ for one hour.

A sample of gauge length 10 mm and diameter 6 mm is cut from the material thus produced, and it is subjected to the superplastic tensile test in the condition of $10^{-3}$ or less of strain rate at 1040° C. The elongation attains to about 200% so that the superplastic forging is confirmed to be possible.

We claim:

1. A method of manufacturing a super-heat-resisting alloy material comprising the steps:
   - cold working a powder of Ni-based super-heat-resisting alloy;
   - filling and sealing the powder in a rubber mold;
   - isostatically cold pressing the powder in the rubber mold into compacted powder;
   - sintering the compacted powder in a vacuum or in a gas atmosphere at a temperature of 1000° C. or more so that the density of the resulting sintered compact material increase up to 95% or more of the theoretical density; and
   - isostatically hot pressing the sintered compact material.

2. The method according to claim 1 wherein said cold pressing occurs at a compacting pressure of 4000 kgf/cm$^2$ or more.

3. The method according to claim 1 wherein said cold working of said powder is processed with a dry attritor.

4. The method according to claim 1 wherein said hot pressing occurs at a temperature between 1100° and 1200° C. at a pressure of 1000 kgf/cm$^2$ or more for thirty minutes or more.

* * * * *